United States Patent [19]

Metz

[11] 4,399,983

[45] Aug. 23, 1983

[54] APPARATUS FOR THE PRODUCTION OF LIQUID IRON, ESPECIALLY FOR DIRECTLY PRODUCING LIQUID IRON FROM ORE

[75] Inventor: Paul Metz, Luxembourg, Luxembourg

[73] Assignee: Arbed S.A., Luxembourg, Luxembourg

[21] Appl. No.: 240,839

[22] Filed: Mar. 5, 1981

[30] Foreign Application Priority Data

Mar. 5, 1980 [LU] Luxembourg ..... 82227

[51] Int. Cl.[3] ..... F27B 3/18

[52] U.S. Cl. ..... 266/176; 266/186; 266/220; 266/225

[58] Field of Search ..... 266/168, 175, 176, 220, 266/225; 75/40, 11, 38

[56] References Cited

U.S. PATENT DOCUMENTS 2,740,710 4/1956 Johannsen ..... 75/40

3,326,671 6/1967 Worner ..... 75/40

FOREIGN PATENT DOCUMENTS 1046675 10/1966 United Kingdom ..... 75/40

*Primary Examiner*—M. J. Andrews

*Attorney, Agent, or Firm*—Michael J. Striker

[57] ABSTRACT

A method for producing liquid iron, especially for producing liquid iron directly from iron ore, mainly comprising the steps of saturating an iron bath in a container by blowing particulate carbon into the bath, dropping iron ore onto a central portion of the bath surface to form a cone of iron ore thereon, blowing oxygen onto an uncovered border zone of the bath surface, blowing particulate carbon by means of a carrier gas into the bath between the bottom of the container and the bath surface, and mixing the bath by blowing a neutral gas through a porous member from a substantially central portion of the bottom of the container in upward direction through the bath, whereby the necessary energy for melting the iron ore is produced by afterburning of the CO producing during blowing of oxygen onto the border zone; and an apparatus for carrying out the method.

4 Claims, 1 Drawing Figure

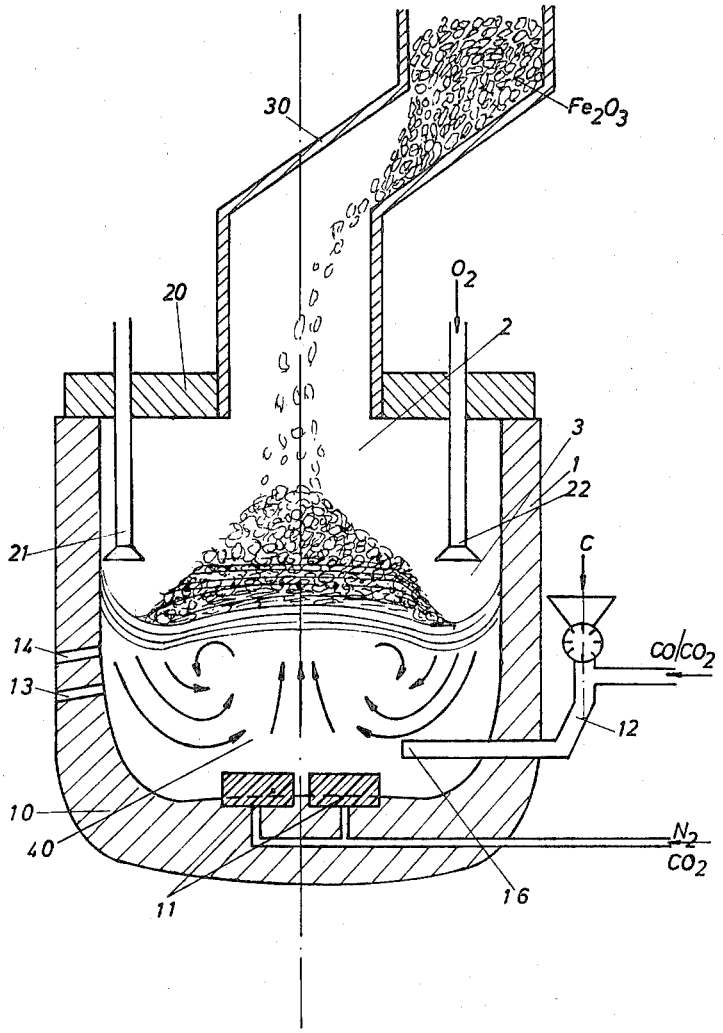
30
$Fe_2O_3$
20
$O_2$
2
3
1
22
21
C
14
13
$co/co_2$
12
10
40
$N_2$
$CO_2$
11
16

APPARATUS FOR THE PRODUCTION OF LIQUID IRON, ESPECIALLY FOR DIRECTLY PRODUCING LIQUID IRON FROM ORE

BACKGROUND OF THE INVENTION

The present invention relates to a method and an apparatus for the production of liquid iron, especially for directly producing liquid iron from iron ore.

Many attempts have already been made for producing liquid iron directly from iron ore.

Thus a method has been disclosed wherein the iron ore is first transformed into sponge iron by means of a suitable gas, whereafter the sponge iron is melted in a metallurgical container, whereby by a reaction of oxygen-containing gases with carbon-containing substances, which are blown into the container beneath the surface of the bath, heat energy as well as carbon monoxide are formed. The heat energy is in part used to melt the sponge iron and the exhaust gas is used for the reduction of ore. In this method it is necessary to treat the exhaust gas in a separate reactor with coal dust and water vapor.

According to another known method, which serves to produce steel from iron ore without a separate pig iron phase, a reducing gas is produced by reacting a fuel with oxygen in a combined melting and gas-producing reactor and the reducing gas is then guided in countercurrent direction to a stream of iron ore in an adjacent reduction space in which the pre-reduced ore at the end of the reduction step is transported into the heated melting and gas-producing reactor to be melted therein and subsequently be completely reduced.

In another known method directed to produce directly pig iron from iron ore, there are provided two separate charging, respectively reaction zones in a melting and gas-producing reactor. In a first zone a carbon carrier is directly introduced into the bath to maintain therein a melt with a carbon content of preferably over 2%. In a second zone bordering the first one, a part of the carbon contained in the melt is burned by means of oxygen, whereby heat and reducing gases are released. The carbon introduced through a lance is therefore in this method used for increasing the melting capacity of the bath and for producing of reduction gases.

The production of strongly reducing gases during a combined reduction and melting process requires, however, extensive and complicated controls in order to assure that the process proceeds in the desired manner, if it is not preferred that the obtained exhaust gas is separately treated in order to obtain therein a sufficient reduction potential.

SUMMARY OF THE INVENTION

It is an object of the present invention to provide a method for the direct production of liquid iron from iron ore and which avoids the disadvantages of such methods known in the art.

It is a further object of the present invention to provide a method for the direct production of liquid iron from iron ore in a single container.

With these and other objects in view, which will become apparent as the description proceeds, the method for the production of liquid iron, especially for directly producing liquid iron from iron ore, mainly comprises the steps of saturating an iron bath in a container with carbon by blowing carbon by means of a neutral or reducing carrier gas into the bath, dropping iron ore onto a central portion of the surface of the bath to form on this surface a cone of iron ore, blowing oxygen on the remaining free border zone of the surface, and flushing the bath with a neutral gas blown through at least one porous member of refractory material located at the bottom of the container.

The invention is therefore based on the idea that the gases developed during blowing of oxygen onto an iron bath saturated with carbon are controlled in their composition by the simultaneous flushing with a neutral gas.

If it is desired to use the exhaust gas for the pre-reduction of ore, it is possible to produce an exhaust gas which practically consists of 100% to CO by means of an increased supply of oxygen during reduced flushing.

In this case an increased oxygen blowing is preferred while the flushing of the bath with an inert gas is reduced to 0–0.1 $Nm^3$/ton of iron/hour.

On the other hand, it is possible by intensely flushing of the bath with an inert gas to produce an afterburning of the developing carbon monoxide at the bath surface, which will occur with considerable development of heat. The amount of flushing gas is then preferably chosen between 0.1 and 0.3 $Nm^3$/ton of iron/hour. The additional heat then developing on the bath surface may be used to melt the iron ore supplied thereto.

The iron bath is further thoroughly mixed with carbon, preferably coal dust carried by the inert gas, whereby if the bath is saturated with carbon, solid carbon not bound to the iron is transported to the bath surface for the reduction of the molten ore.

The transmission of heat to the bath itself is produced by continuous or intermittent blowing of oxygen onto the bath surface. The blowing of oxygen onto the bath surface is thereby not obstructed by the presence of molten or freshly introduced iron ore, since the latter is admitted essentially to a central zone of the bath surface.

By a proper arrangement of the blowing lance for the oxygen, the introduction nozzle for the carbon carrier and the porous member of refractory material, flow conditions within the bath are obtained which generally will be in the downward direction along the side walls of the container and in upward direction from the center of the container bottom. This will assure that in the central zone, at which the bath surface is impinged with ore, the main afterburning of the CO will occur, which will produce the necessary energy for melting the ore, and that also carbon will be transported to this central zone which serves for the reduction of the ore. The bath will be saturated with oxygen and heated up at the peripheral zone of the bath surface.

The amount of material residing at any time within the container may be estimated from the amount of raw material fed thereinto and the amount of the liquid products discharged therefrom, or other known methods can be used in order to ascertain the amount of material residing at any time in the container.

The present invention resides also in an apparatus for carrying out the above-mentioned method, and this apparatus mainly comprises a metallurgical container in which an iron bath is maintained and which is closed by a cover provided with a central opening connected to an upwardly extending tubular chute for introduction of iron ore and at least one oxygen-blowing lance extending through the cover and directed to a peripheral zone of the bath and a blowing lance for blowing particulate carbon below the bath surface, whereas at least one porous member of refractory material is arranged at the central portion of the bottom of the container for blowing an inert gas therethrough.

The lance for blowing particulate carbon into the bath is arranged preferably adjacent the aforementioned member of refractory material, and the outlet end of this lance is preferably located between the aforementioned member and the side wall of the container. By corresponding adjustment of the gas pressure of the gases passing through the blowing lance for the oxygen, the lance for the particulate carbon and the member of refractory material, it is possible to provide flow conditions in the bath which extend downwardly along the inner surface of the container and upwardly in a central zone thereof.

Due to the heat produced by the afterburning of CO directly at the bath surface, it is possible to charge the container with finely comminuted ore or also with lumpy ore so that expensive comminuting of the ore may be avoided.

With the method according to the present invention liquid iron with a carbon content above 2% is produced, which preferably is transmitted to a continuously operating refining installation.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing illustrates the apparatus according to the present invention in a schematic vertical cross section.

DESCRIPTION OF A PREFERRED EMBODIMENT

Referring now to the drawing, it will be seen that the apparatus according to the present invention mainly comprises a metallurgical container 1 in which a bath 40 of molten iron is maintained. The upper open end of the container is closed by a cover 20 provided with a central opening through which a tubular chute 30 extends for feeding iron ore ($Fe_2O_3$) into the container to form a cone of iron ore 2 on a central portion of the bath. A pair of blowing lances 21, 22 for blowing oxygen onto a peripheral zone 3 of the bath not covered by the iron ore extends in downward direction through the cover 20. A pair of porous members 11 of refractory material is arranged at a central portion of the bottom 10 of the container through which nitrogen or carbon dioxide is blown in upward direction through a central portion of the bath 40. An additional lance 12 extends in transverse direction through a container wall and has an outlet nozzle 16 above the members 11 and between the latter and the one side wall of the container, through which particulate carbon is blown into the bath 40 by means of a carrier gas which may be CO or $CO_2$. The container is further provided in a side wall thereof with tap holes 13 and 14 for the discharge of liquid metal respectively slag.

It will be understood that each of the elements described above, or two or more together, may also find a useful application in other types of methods for the production of liquid iron differing from the types described above.

While the invention has been illustrated and described as embodied in a method for the production of liquid iron, especially for directly producing liquid iron from iron ore, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for the production of liquid iron, especially for directly producing liquid iron from iron ore, comprising a metallurgical container having a bottom and an opposite open end and adapted to contain a bath of iron; a cover extending over the open end of said container and having a central opening; a tubular chute projecting upwardly from said opening for feeding iron ore onto a central portion of an iron bath in said container so that the iron ore will form a cone on a central portion of the surface of the bath while leaving an uncovered border zone around the cone on the bath surface; means for blowing oxygen onto said border zone of the bath surface; means for blowing particulate carbon into the bath below the surface thereof; and means for blowing a neutral gas from a central portion of the bottom of the container in upward direction through the bath.

2. Apparatus as defined in claim 1, wherein said means for blowing oxygen onto the border zone of the bath comprises at least one blowing lance extending through said cover and having an outlet end above the bath surface at the border zone.

3. Apparatus as defined in claim 1, wherein said means for blowing particulate carbon into the bath comprising a blowing lance having an outlet end spaced from a peripheral wall of the container between the bath surface and the bottom of the container.

4. Apparatus as defined in claim 1, wherein said means for blowing a neutral gas upwardly and centrally from the bottom of the container into the bath comprises at least one porous member of refractory material mounted in the bottom of the container and means for blowing a gas under pressure through said member.

* * * * *